US009987645B2

(12) United States Patent
Richman et al.

(10) Patent No.: US 9,987,645 B2
(45) Date of Patent: Jun. 5, 2018

(54) CONCENTRATED CLEANING CAPSULE AND ATOMIZER FOR DISPENSING CLEANING SOLUTION THEREFROM

(71) Applicant: Butler's Brand, Inc., New York, NY (US)

(72) Inventors: Steven C. Richman, Cold Springs Harbor, NY (US); David N. Youdovin, New York, NY (US)

(73) Assignee: Butler's Brand, Inc., New York, NY (US)

( * ) Notice: Subject to any disclaimer, the term of this patent is extended or adjusted under 35 U.S.C. 154(b) by 35 days.

(21) Appl. No.: 15/210,976

(22) Filed: Jul. 15, 2016

(65) Prior Publication Data

US 2017/0014843 A1 Jan. 19, 2017

Related U.S. Application Data

(60) Provisional application No. 62/193,813, filed on Jul. 17, 2015.

(51) Int. Cl.
*B05B 7/24* (2006.01)
*B05B 11/00* (2006.01)

(52) U.S. Cl.
CPC ..... *B05B 11/0054* (2013.01); *B05B 11/0037* (2013.01); *B05B 11/0081* (2013.01); *B05B 11/3057* (2013.01); *B05B 15/30* (2018.02); *B05B 7/2472* (2013.01)

(58) Field of Classification Search
CPC ..... B05B 11/3057; B05B 11/0037; B05B 15/005; B05B 11/0054; B05B 11/0081; B05B 7/2472; B05B 15/30; B67B 7/28; B65D 51/2835
USPC ..... 222/80, 81, 83, 85, 82, 325
See application file for complete search history.

(56) References Cited

U.S. PATENT DOCUMENTS 2,655,286 A * 10/1953 Barbaro ..... B67B 7/28 222/156
3,655,096 A * 4/1972 Easter ..... B05B 11/0078 206/222
3,966,089 A * 6/1976 Klingaman ..... B05B 11/0078 222/88
5,836,479 A * 11/1998 Klima ..... B05B 11/0056 222/130
6,997,351 B2 * 2/2006 Cho ..... B05B 11/0081 206/222

(Continued)

*Primary Examiner* — Nicholas J Weiss
*Assistant Examiner* — Robert Nichols, II
(74) *Attorney, Agent, or Firm* — Alston & Bird LLP

(57) ABSTRACT

In an example embodiment, an atomizer for dispensing cleaning solution from a capsule is provided. The atomizer comprises a handle, a base, and a pipette extending from the base to the nozzle. The handle comprises a nozzle, a trigger, and a capsule receiving portion. The base comprises a reservoir portion configured for receiving cleaning solution from the capsule. The handle is configured to be secured to the base. When the capsule is positioned within the capsule receiving portion and the handle is secured to the base the cleaning solution is provided to the reservoir portion. When the capsule is positioned within the capsule receiving portion, the handle is secured to the base, and the trigger is activated, the cleaning solution is dispensed from the reservoir portion through the pipette and out of the nozzle.

14 Claims, 4 Drawing Sheets

(56) References Cited

U.S. PATENT DOCUMENTS

Figure 1:
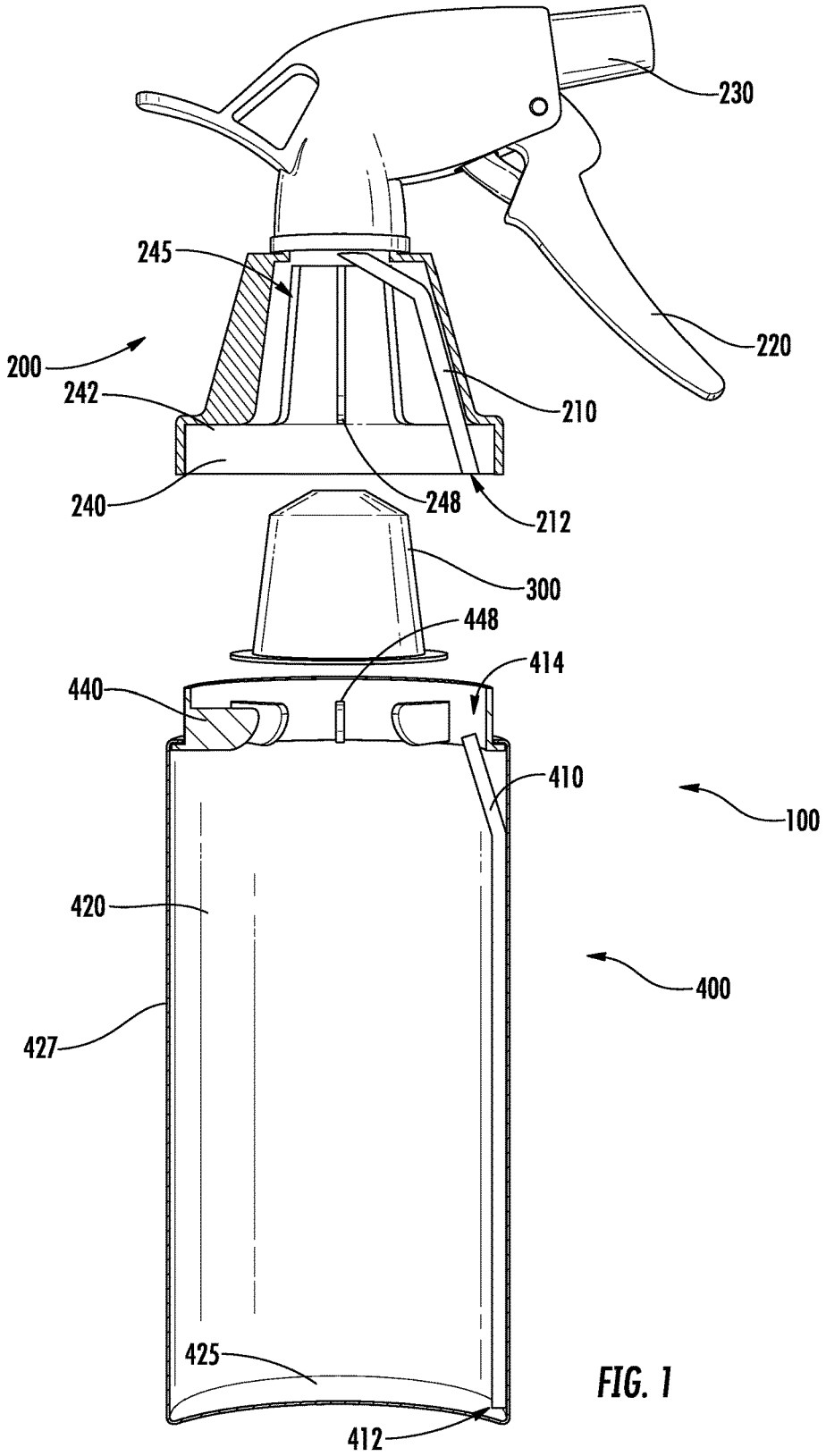

| | | | | |
|---|---|---|---|---|
| 8,281,960 | B1 * | 10/2012 | Gers | B05B 11/3011 222/377 |
| 2005/0224515 | A1 * | 10/2005 | Mon | B05B 11/0081 222/82 |
| 2006/0086759 | A1 * | 4/2006 | Herzog | G01F 11/028 222/321.9 |
| 2009/0212077 | A1 * | 8/2009 | Carden | B05B 15/30 222/382 |

* cited by examiner

CONCENTRATED CLEANING CAPSULE AND ATOMIZER FOR DISPENSING CLEANING SOLUTION THEREFROM

CROSS-REFERENCE TO RELATED APPLICATIONS

This application claims priority to U.S. Provisional Application No. 62/193,813 filed Jul. 17, 2015, the contents of which are incorporated herein in their entirety by reference.

BACKGROUND

In general, a user may wish to have various cleaning solutions for cleaning different surfaces. For example, a user may wish to have a glass cleaning solution, a bath cleaning solution, a general purpose kitchen cleaning solution, a metal cleaning solution, and/or the like. However, traditional cleaning arrangements require users to maintain store separate reservoirs of cleaning solution corresponding to each desired use cleaning solution. The user may not want or be able to dedicate enough storage space to a plurality of reservoirs of cleaning solution to accommodate a plurality of different reservoirs of cleaning solutions.

BRIEF SUMMARY

Example embodiments of the present invention provide concentrated cleaning capsules configured to store concentrated cleaning solution and an atomizer for dispensing the concentrated cleaning solution therefrom. Example embodiments of the present invention allows a user to have multiple types of cleaning solution, without requiring the user to have multiple atomizers. Example embodiments of the present invention provide a user with a single use amount of cleaning solution.

According to one aspect of the present invention, an atomizer for dispensing a cleaning solution from a capsule is provided. In an example embodiment, the atomizer comprises a handle, a base, and a pipette extending from the base to the nozzle. The handle comprises a nozzle, a trigger, and a capsule receiving portion. The base comprises a reservoir portion configured for receiving cleaning solution from the capsule. The handle is configured to be secured to the base. When the capsule is positioned within the capsule receiving portion and the handle is secured to the base, the cleaning solution is provided to the reservoir portion. When the capsule is positioned within the capsule receiving portion, the handle is secured to the base, and the trigger is activated, the cleaning solution is dispensed from the reservoir portion through the pipette and out of the nozzle.

In an example embodiment, the pipette is a bifurcated pipette comprising a handle pipette disposed in the handle and a base pipette disposed in the base. When the handle is secured to the base, the base pipette aligns with the handle pipette. In an example embodiment, screwing the handle onto the base causes the alignment of an outlet of the base pipette and a mouth of the handle pipette such that cleaning solution exiting the outlet of the base pipette enters the mouth of the handle pipette.

In an example embodiment, a wall of the reservoir portion defines at least a portion of the base pipette. In an example embodiment, the reservoir portion is configured to receive a dilution chemical configured to dilute the cleaning solution. The dilution chemical is dispensed from the reservoir portion through the pipette and out of the nozzle with the cleaning solution. In an example embodiment, the dilution chemical comprises water.

In an example embodiment, the handle comprises a first puncture pin configured to puncture a cup portion of the capsule. In an example embodiment, the capsule is configured to be inserted into the handle and securing the capsule into the handle causes the first puncture pin to puncture the cup portion of the capsule. In an example embodiment, the base comprises a second puncture pin configured to puncture a lid portion of the capsule. In an example embodiment, the handle is configured to be screwed onto the base. Screwing the handle onto the base causes at least one of (a) the first puncture pin to create a first puncture hole in the capsule or (b) the second puncture pin to create a second puncture hole in the capsule. In an example embodiment, screwing the handle onto the base causes the cleaning solution to be infused into the reservoir portion and secures the capsule within the atomizer.

In an example embodiment, the capsule is configured to contain 1-2 ounces of the cleaning solution. In an example embodiment, the reservoir portion has a convex end surface configured to direct the cleaning solution toward a mouth of the pipette. In an example embodiment, the mouth of the pipette is located along a joining point of the end surface of the reservoir portion and a wall of the reservoir portion. In an example embodiment, the base comprises a metal. In an example embodiment, the reservoir portion has a capacity of 10-30 ounces.

According to another aspect of the present invention, a capsule is provided. In an example embodiment, a capsule comprises a cup portion; a ridge portion; and a lid portion. The lid portion is configured to seal cleaning solution within the cup portion. The ridge portion is configured for securing the capsule within an atomizer.

In example embodiments, the capsule is configured to contain 1-2 ounces of the cleaning solution. In example embodiments, at least a portion of the capsule comprises metal.

According to yet another aspect of the present invention, a method of dispensing a cleaning solution from a capsule is provided. In an example embodiment, the method comprises providing an atomizer. The atomizer comprises a handle configured to receive a capsule containing cleaning solution therein, a base, and a pipette extending from the base to a nozzle. The handle comprises the nozzle, a trigger, and a capsule receiving portion. The base comprises a reservoir portion configured for receiving cleaning solution from the capsule. The method further comprises inserting the capsule into the capsule receiving portion; securing the handle to the base; and opening the cleaning capsule to enable the cleaning solution to flow into the reservoir portion. The method further comprises diluting the cleaning solution with a dilution chemical in the reservoir portion and activating the trigger. Activating the trigger causes cleaning solution and dilution chemical to be dispensed from the reservoir portion, through the pipette, and out of the nozzle.

BRIEF DESCRIPTION OF THE SEVERAL VIEWS OF THE DRAWING(S)

Figure 2:
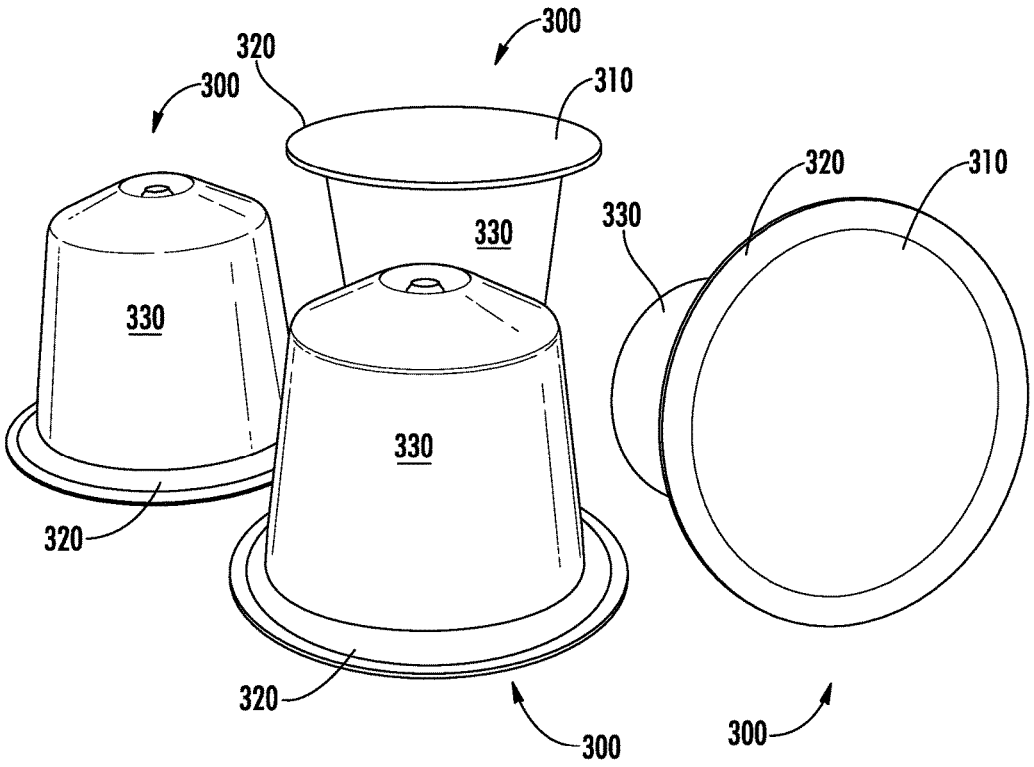
Figure 3:
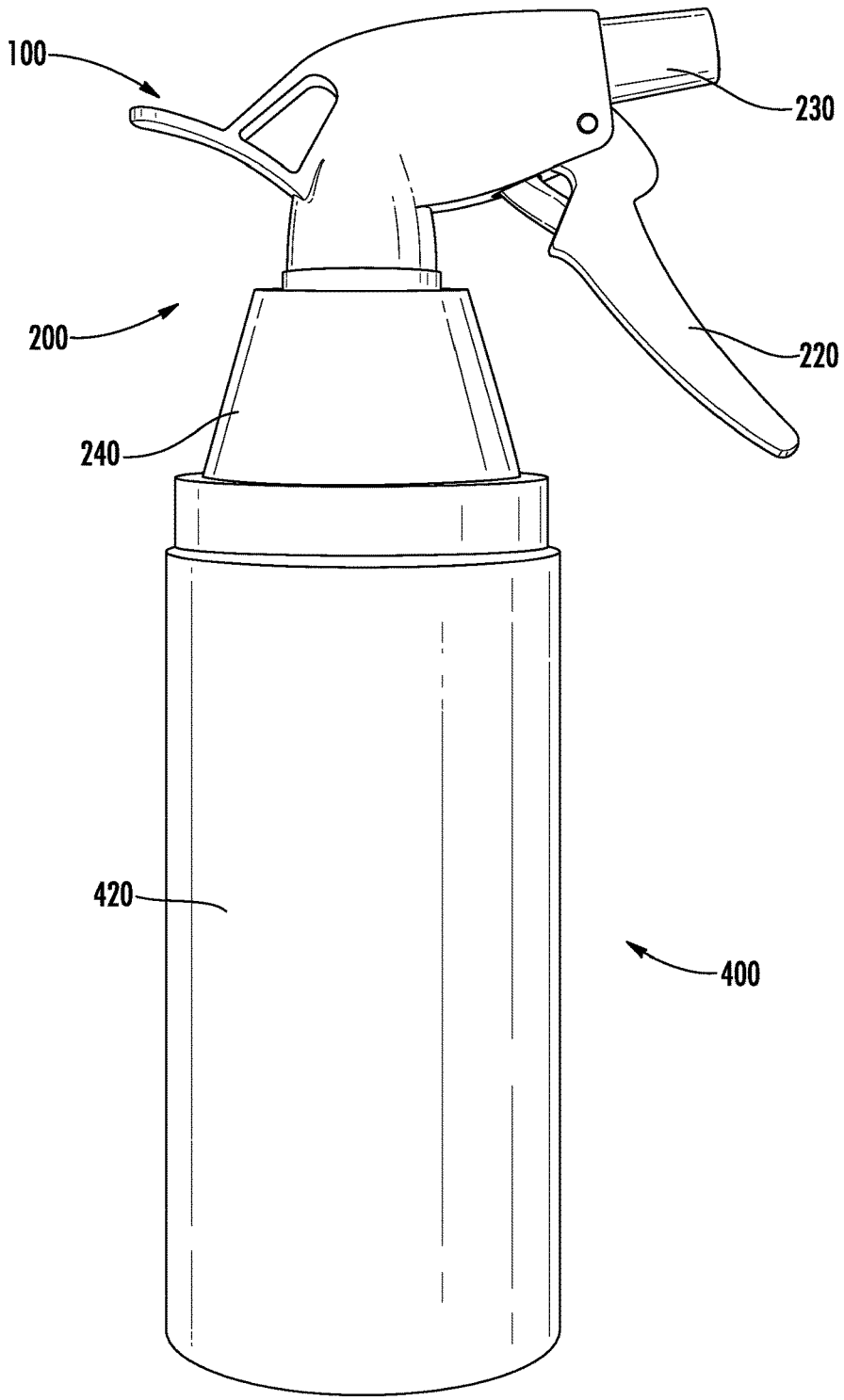
Figure 4:
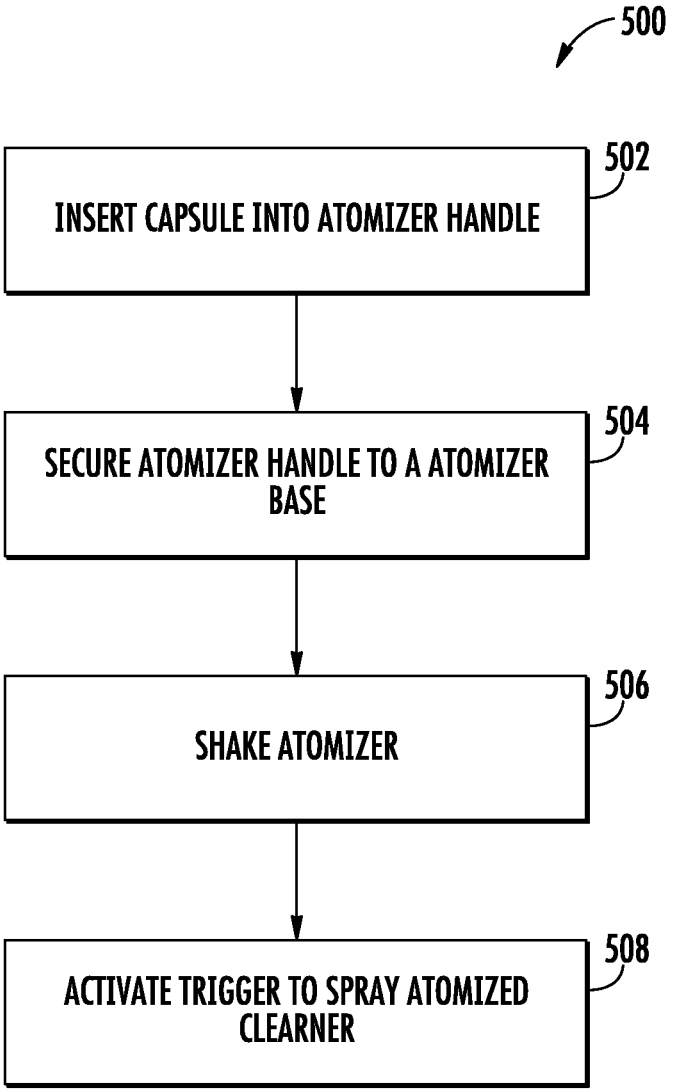

Having thus described the invention in general terms, reference will now be made to the accompanying drawings, which are not necessarily drawn to scale, and wherein:

FIG. 1 is a partially exploded cross-section view of an atomizer with a cleaning capsule therein, in accordance with an example embodiment;

FIG. 2 provides perspective views of four cleaning capsules, in accordance with example embodiments;

FIG. 3 is a perspective view of an atomizer, in accordance with an example embodiment; and FIG. 4 provides a flowchart illustrating various processes for using an atomizer and cleaning capsule, in accordance with example embodiments.

DETAILED DESCRIPTION EXAMPLE EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Example embodiments of the present invention provide cleaning capsules for storing and providing concentrated cleaning solution and an atomizer for diluting the concentrated cleaning solution and dispensing the diluted cleaning solution. FIGS. 1, 2, and 3 show an example atomizer 100 and example cleaning capsules 300. In general, a user may place a cleaning capsule 300 within an atomizer 100 to provide cleaning solution to the atomizer. The user may then use the cleaning solution. In an example embodiment, a cleaning capsule 300 may be configured to contain approximately one cleaning session worth of cleaning solution such that when the user is finished cleaning, the user need not store unused cleaning solution. The atomizer 100 may generally comprise a handle 200 and a base 400. In example embodiments, the handle 200 may be configured to receive a cleaning capsule 300 therein and provide a trigger 220 and a nozzle 230 such that when the trigger is activated, the cleaning solution is dispensed through the nozzle 230. Various aspects of cleaning capsules 300 and the atomizer 100 will now be described in more detail below.

Exemplary Cleaning Capsule

In example embodiments, the cleaning capsule 300 comprises a cup portion 330 and a lid portion 310. The cup portion 330 is configured to hold cleaning solution therein. The lid portion 310 is configured to seal the cleaning solution within the cup portion 330. The cleaning capsule 300 may further comprise a ridge portion 320. The ridge portion 320 may be where the lid portion 310 is secured to the cup portion 330. The ridge portion 320 may further be configured to assist in securing the cleaning capsule 300 into the handle 200 of the atomizer. For example, the ridge portion 320 may be configured to aid in the alignment of the cleaning capsule within the handle 200 of the atomizer 100 or be secured within the handle 200 or other portion of the atomizer 100.

In example embodiments, the cup portion 330 is configured to hold one to two ounces of cleaning solution. In other embodiments, smaller or larger volumes of cleaning solution may be accommodated by the cup portion 310. In an example embodiment, the cup portion 330 is configured to hold a single cleaning session worth of cleaning solution. For example, the cup portion 330 may be configured to hold enough cleaning solution to clean the windows of one house or apartment, to clean one bathroom, and/or the like. In various embodiments, the cup portion 330 may be configured to hold between about 10-100 doses (each dose corresponding to a single actuation of the atomizer to dispense a dose of cleaning solution through the nozzle). In example embodiments, the cleaning solution may be a concentrated cleaning solution. In some embodiments, the concentrated cleaning solution may be of a cleaning solution strength that is ready to use. In some embodiments, the cleaning solution may be intended to be diluted (e.g., by putting water or another dilution chemical into the reservoir portion 420 before the cleaning solution to the reservoir portion). For example, the cleaning solution may be a bathroom cleaning solution, window cleaning solution, metal cleaning solution, general purpose or universal cleaning solution, and/or the like. In example embodiments, the cup portion 330 may be color-coded based on the cleaning solution type contained therein. In example embodiments, the cup portion 330 may be made of aluminum, another metal, or another appropriate material.

In example embodiments, the lid portion 310 may be configured to seal the cleaning solution within the cup portion 330. For example, the cup portion 330 may comprise an opening and the lid portion 310 may seal the opening. In example embodiments, the lid portion 310 comprises aluminum (e.g., a rigid sheet of aluminum and/or aluminum foil), another metal, or other appropriate material. In an example embodiment, the lid portion 310 may be a foil lid. The lid portion 310 may have information/data printed thereon. For example, the printed information/data may comprise a cleaning solution type indicator, branding, and/or other printed information and/or indicia. The printed information/indicia may be on an exterior surface of the lid portion 310 opposite the side of the lid portion 310 that directly faces the opening of the cup portion 330.

In example embodiments, the lid portion 310 may be sealed to the cup portion 330 to a ridge portion 320 surrounding the opening of the cup portion 330. The ridge portion 320 may be configured to assist in securing the cleaning capsule 300 into the atomizer 100. For example, when the cleaning capsule 300 is properly inserted into the handle 200, the ridge portion 320 may be configured to abut a seat 242 within an attachment portion 240 of the handle 200. When the base 400 is secured to the handle 200, the ridge portion 320 may be engaged by both an upper lip of the attachment portion 440 of the base 400 and a seat 242 within the attachment portion 240 of the handle 200, thereby holding the cleaning capsule 300 in place with respect to components of the atomizer 100.

Exemplary Handle

In example embodiments, the handle 200 comprises a handle pipette 210, a trigger 220, a nozzle 230, and an attachment portion 240. The handle pipette 210 is configured to, when the trigger 220 is activated, receive cleaning solution from a base pipette and provide the cleaning solution to the nozzle 230. The attachment portion 240 is configured to secure the handle 200 to the base 400 and/or to secure the cleaning capsule 300 into the handle 200. In example embodiments, various portions of the handle 200 may comprise aluminum, another metal, and/or other appropriate resilient material.

In example embodiments, the handle pipette 210 is a part of a bifurcated pipette (comprising the handle pipette 210 and the base pipette 410) comprises a mouth 212 that is configured to, when the handle 200 is secured to the bottom 400, align with the outlet 414 of the base pipette 410. Herein, the outlet 414 aligning with the mouth 212 defines a sufficient seal between the outlet 414 and the mouth 212 such that a pressure differential along the combined length of the base pipette 410 and the handle pipette 210 may be maintained. Thus, the handle pipette 210 may receive cleaning solution from the outlet 414 of the base pipette 410 and into the mouth 212 of the handle pipette 210. The handle pipette 210 may then provide the cleaning solution to the nozzle 230 for dispensing. The nozzle 230 may be adjustable such that a user may select how directed the stream and/or mist of cleaning solution is that is dispensed through the nozzle 230. In an example embodiment, the nozzle 230 and the general direction in which the nozzle 230 dispenses the cleaning solution defines a nozzle axis. The combined handle pipette 210 and the base pipette 410 define a pipette axis. The nozzle axis and pipette axis intersect and define a plane. In example embodiments, the angle between the nozzle axis and the pipette axis in the plane is between 60 and 120 degrees. In an example embodiment, the angle between the nozzle axis and the pipette axis in the plane is between 80 and 100 degrees or approximately 90 degrees.

When the handle 200 is secured to the base 400, the cleaning solution may be forced into the handle pipette 210, from the base pipette 410, in response to the trigger 220 being activated. For example, a user may squeeze, press, pull, push, or otherwise activate the trigger 220 to cause cleaning solution to be dispensed from the nozzle 230. For example, when the trigger 220 is activated, the cleaning solution is pumped from the reservoir portion 420 through the base pipette 410, into the handle pipette 210, and dispensed out of the nozzle 230. For example, the trigger 220 may be actuated to create a pressure differential along the combined length of the base pipette 410 and the handle pipette 210, causing the cleaning solution to be dispensed from the reservoir portion 420 through the base pipette 410, into the handle pipette 210, and out of the nozzle 230.

The attachment portion 240 of the handle 200 is configured to secure the handle 200 to the base 400 and/or to secure the cleaning capsule 300 within the handle 200. In example embodiments, the attachment portion 240 may comprise a seat 242 configured to have the ridge portion 320 of the cleaning capsule 300 engage therewith. The attachment portion may further comprise a cup receiving portion 245 configured to receive the cup portion 330 of a cleaning capsule 300 therein. The attachment portion 240 may further comprise a mechanism for at least partially opening the cleaning capsule. For example, the attachment portion 240 may comprise a first puncture pin 248 configured to at least partially open (e.g., puncture) the cleaning capsule 300 (e.g., the cup portion 330 of the cleaning capsule 300) when the base 400 is secured to the handle 200 and the cleaning capsule 300 is engaged with the seat. For example, the first puncture pin 248 may be disposed in the cup receiving portion 245. The attachment portion 240 may comprise threads or another mechanism for securing the handle 200 to the base 400. For example, the attachment portion 440 of the base may comprise corresponding threads such that the base 400 may be screwed onto the handle 200. In example embodiments, the attachment portion 240 is configured to have the cleaning capsule 300 inserted therein such that the cup portion 330 is fully within the attachment portion 240. The attachment portion 240 is further configured such that when the base 400 is secured to the handle 200, the mouth 212 of the handle pipette 210 is aligned with the outlet 414 of the base pipette 400. In an example embodiment, a sealing member (e.g., a rubber washer or the like) may be positioned about the mouth 212 of the handle pipette 210 such that cleaning solution does not leak at the junction point of the mouth 212 of the handle pipette 210 and the outlet 414 of the base pipette 414 and such that the pressure differential along the combined length of the handle pipette 210 and the base pipette 410 is not disrupted.

Exemplary Base

In example embodiments, the atomizer 100 comprises a base 400. The base 400 may comprise a base pipette 410, a reservoir portion 420, and an attachment portion 440. In example embodiments, the attachment portion 440 is configured to secure the base 400 to the top 200. The reservoir portion 420 is configured to receive cleaning solution therein and provide the cleaning solution to the mouth 412 of the base pipette 410. The base pipette 410 provides the cleaning solution to the handle pipette 210 for dispensing of the cleaning solution. In example embodiments, the base 400 may comprise aluminum, another metal, or other appropriate material.

In example embodiments, the reservoir portion 420 may comprise a hollow portion within the base 400 configured for receiving cleaning solution therein from the cleaning capsule 300. For example, the cleaning capsule 300 may provide cleaning solution to the reservoir portion 420. The reservoir portion 420 may contain the cleaning solution therein. In example embodiments, the reservoir portion 420 may be configured to receive and/or contain a dilution chemical (e.g., water) therein for mixing with concentrated cleaning solution provided by the cleaning capsule 300. In example embodiments, the reservoir portion 420 may be configured to have a dilution chemical (e.g., water) and concentrated cleaning solution mixed therein to provide a diluted concentrated cleaning solution.

The reservoir portion 420 may further comprise an end surface 425. The end surface 425 may define one end of the hollow portion. Wall 427 may join the end surface 425 to the attachment portion 440. The interior of the wall 427 and the end surface 425 may define the hollow portion of the reservoir portion 420. The end surface 425 may be convex toward the interior of the reservoir portion 420 (e.g., may curve up into the hollow portion) to cause the cleaning solution to be directed toward the mouth 412 of the base pipette 410. Thus, if the atomizer 100 is held such that the handle 200 is on top of the base 400, gravity will cause the cleaning solution within the reservoir portion 420 to move toward the perimeter of the end surface 425 where the end surface 425 joins with the wall 427. In example embodiments, the mouth 412 of the base pipette 410 may be located proximate the joining of the wall 427 to the bottom surface 425, as shown in FIG. 1.

In example embodiments, the base 400 comprises a base pipette 410. The base pipette 410 comprises a mouth 412 and an outlet 414. The mouth 412 is located within the reservoir portion 420. For example, the mouth 412 may be located near where the wall 427 joins with the end surface 425. The outlet 414 may be located in the attachment portion 440 and configured to be aligned with the mouth 212 of the handle pipette 210. In example embodiments, the base pipette 410 may be at least partially secured to the wall 427 within the hollow portion of the reservoir portion 420. In some example embodiments, the base pipette 410 may be at least partially enclosed within the wall 427. For example, the base pipette 410 may be a tube at least partially embedded with the wall 427. Thus, in example embodiments, the base pipette 410 is configured to be secured to the base 400 and to generally not move with respect to other components of the base 400.

In example embodiments, the attachment portion 440 of the base 400 comprises a mechanism for securing the base 400 to the handle 200. For example, the attachment portion 440 of the base 400 may comprise threads that correspond to threads on the attachment portion 240 of the handle 200. The attachment portion 440 may further comprise a mechanism configured to at least partially open the cleaning capsule 300. For example, the attachment portion 440 may comprise a second puncture pin 448. When the base 400 is secured to the handle 200, the second puncture pin 448 may be configured to at least partially open (e.g., puncture a hole in) the lid portion 320 of a cleaning capsule 300 that has been inserted into the handle 200. Thus, the second puncture pin 448 may be configured to infuse, release, provide, and/or the like the cleaning solution from the cleaning capsule 300 into the reservoir portion 420 of the base 400. In an example embodiment, the cleaning capsule 300 is at least partially opened by both a mechanism of the handle attachment portion 240 (e.g., the first puncture pin 248) and a mechanism of the base attachment portion 440 (e.g., the second puncture pin 448) to infuse, release, provide, and/or the like the cleaning solution from the cleaning capsule 300 into the reservoir portion 420.

The attachment portion 440 is further configured such that when the base 400 is secured to the handle 200, the outlet 414 of the base pipette 400 is aligned with the mouth 212 of the handle pipette 210. In an example embodiment, a sealing member (e.g., a rubber washer or other sealing element) may be positioned about the outlet 414 of the base pipette 410 such that cleaning solution does not leak at the junction point of the mouth 212 of the handle pipette 210 and the outlet 414 of the base pipette 414 and such that the pressure differential along the combined length of the handle pipette 210 and the base pipette 410 is not disrupted.

Exemplary Method of Use

FIG. 4 provides a flowchart that illustrates various processes that may be completed to dispense a cleaning solution from an atomizer 100. Starting at block 502, a cleaning capsule 300 is inserted into a handle 200 of the atomizer 100. For example, a user may insert a cleaning capsule 300 into the handle 200 of the atomizer 100 such that the cup portion 330 of the cleaning capsule is within the handle 200 and the ridge portion 320 rests against a seat of the attachment portion 240 of the handle 200. For example, the cup portion 300 may be pressed against a first puncture pin of the attachment portion 240. In some embodiments, the user may press the cleaning capsule into the handle 200 until the first puncture pin punctures the cup portion 330 to create a puncture hole. In other embodiments, the cleaning capsule 300 may rest against and/or be positioned in the vicinity of the first puncture pin but not actually engaged with the first puncture pin at this point.

At block 504, the base 400 is secured to the handle 200. For example, threads of the attachment portion 440 may be rotationally secured to corresponding threads of the attachment portion 240. In example embodiments, securing the base 400 to the handle 200 secures the cleaning capsule 300 within the atomizer. For example, an upper lip of the attachment portion 440 may engage the ridge portion 320 of the cleaning capsule 300 to press the opposite side of the ridge portion 320 (e.g., the cup portion 310 side) against and/or into engagement with the seat of the attachment portion 240. Securing the base 400 to the handle 200 may further cause the second puncture pin to open (e.g., puncture) the lid portion 310. Thus, a puncture hole may be created in the lid portion 310. If the first puncture pin has not yet punctured the cup portion 330, the securing of the base 400 to the handle 200 may cause the first puncture pin to puncture the cup portion 330. Thus, the cleaning solution may be infused, released, provided, and/or the like into the reservoir portion 420. In some embodiments, the cleaning solution is not infused, released, provided and/or the like into the reservoir portion 420 until both the first puncture pin and the second puncture pin have punctured the cleaning capsule 300.

In an example embodiment, before securing the handle 200 to the base 400, the reservoir portion 420 may be at least partially filled with a dilution chemical (e.g., water). Thus, when the concentrated cleaning solution is provided to the reservoir portion 420 (when the handle 200 is secured to the base 400), the resulting cleaning solution may be a regular strength cleaning solution. For example, the concentrated cleaning solution provided by the cleaning capsule 300 to the reservoir portion 420 may be diluted to a less concentrated cleaning solution.

At block 506, the atomizer 100 may be shaken. For example, the user may shake the atomizer 100. In example embodiments, shaking the atomizer 100 may cause at least a portion of any cleaning solution still residing the cleaning capsule 300 to be infused, released, and/or provided to the reservoir portion 420. In another example, shaking the atomizer 100 may cause the concentrated cleaning solution to mix generally uniformly with any dilution chemical (e.g., water) within the reservoir portion 420 such that the resulting solution is a diluted concentrated cleaning solution.

At block 508, the trigger 220 may be activated to cause the cleaning solution to be dispensed. For example, the user may activate the trigger 220 by pulling, pushing, pumping, pressing, squeezing, or otherwise activating the trigger 220. When the trigger 220 is activated, a pressure differential along the combined length of the handle pipette 210 and the base pipette 410 may cause cleaning solution to enter the mouth 412 of the base pipette 410, traverse the base pipette 410, exit the base pipette 410 at the outlet 414 and enter the mouth 212 of the handle pipette 210, and be provided to the nozzle 230, from which the cleaning solution is dispensed. Thus, activating the trigger 220 causes cleaning solution to be dispensed from the reservoir portion 420, through the base pipette 410, into the handle pipette 210, and out of the nozzle 230.

CONCLUSION

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An atomizer for dispensing a cleaning solution from a capsule, the atomizer comprising:

a handle, the handle comprising:

a nozzle, a trigger, a capsule receiving portion, and a first puncture pin configured to puncture a cup portion of the capsule;

a base, the base comprising:

a reservoir portion configured for receiving cleaning solution from the capsule, and a second puncture pin configured to puncture a lid portion of the capsule; and a pipette extending from the base to the nozzle;

wherein the handle is configured to be secured to the base, and when the capsule is positioned within the capsule receiving portion and the handle is secured to the base, (a) the cleaning solution is provided to the reservoir portion and (b) when the trigger is activated, the cleaning solution is dispensed from the reservoir portion through the pipette and out of the nozzle, and wherein the pipette is a bifurcated pipette comprising a handle pipette disposed in the handle and a base pipette disposed in the base and wherein when the handle is secured to the base, the base pipette aligns with the handle pipette.

2. The atomizer of claim 1, wherein screwing the handle onto the base causes the alignment of an outlet of the base pipette and a mouth of the handle pipette such that cleaning solution exiting the outlet of the base pipette enters the mouth of the handle pipette.

3. The atomizer of claim 1, wherein a wall of the reservoir portion defines at least a portion of the base pipette.

4. The atomizer of claim 1, wherein the reservoir portion is configured to receive a dilution chemical configured to dilute the cleaning solution, and wherein the dilution chemical is dispensed from the reservoir portion through the pipette and out of the nozzle with the cleaning solution.

5. The atomizer of claim 4, wherein the dilution chemical comprises water.

6. The atomizer of claim 1, wherein (a) the capsule is configured to be inserted into the handle and (b) securing the capsule into the handle causes the first puncture pin to puncture the cup portion of the capsule.

7. The atomizer of claim 6, wherein (a) the handle is configured to be screwed onto the base and (b) screwing the handle onto the base causes at least one of (i) the first puncture pin to create a first puncture hole in the capsule or (ii) a second puncture pin of the base to create a second puncture hole in the capsule.

8. The atomizer of claim 1, wherein screwing the handle onto the base causes the cleaning solution to be infused into the reservoir portion and secures the capsule within the atomizer.

9. The atomizer of claim 1, wherein the capsule is configured to contain 1-2 ounces of the cleaning solution.

10. The atomizer of claim 1, wherein the reservoir portion has a convex end surface configured to direct the cleaning solution toward a mouth of the pipette.

11. The atomizer of claim 10, wherein the mouth of the pipette is located along a joining point of the end surface of the reservoir portion and a wall of the reservoir portion.

12. The atomizer of claim 1, wherein the base comprises a metal.

13. The atomizer of claim 1, wherein the reservoir portion has a capacity of 10-30 ounces.

14. A method of dispensing a cleaning solution from a capsule, the method comprising:

providing an atomizer, the atomizer comprising:

a handle configured to receive a capsule containing cleaning solution therein, the handle comprising:

a nozzle, a trigger, a capsule receiving portion, and a first puncture pin configured to puncture a cup portion of the capsule;

a base, the base comprising;

a reservoir portion configured for receiving cleaning solution from the capsule, and a second puncture pin configured to puncture a lid portion of the capsule; and a pipette extending from the base to the nozzle, wherein the pipette is a bifurcated pipette comprising a handle pipette disposed in the handle and a base pipette disposed in the base and wherein when the handle is secured to the base, the base pipette aligns with the handle pipette;

inserting the capsule into the capsule receiving portion;

securing the handle to the base;

opening the capsule via at least one of the first puncture pin and the second puncture pin to enable the cleaning solution to flow into the reservoir portion;

diluting the cleaning solution with a dilution chemical in the reservoir portion; and activating the trigger, thereby causing cleaning solution and dilution chemical to be dispensed from the reservoir portion, through the pipette, and out of the nozzle.

* * * * *